US005422547A

United States Patent [19]

Brownell

[11] Patent Number: 5,422,547

[45] Date of Patent: Jun. 6, 1995

[54] FLUORESCENT LAMP CONTROL CIRCUIT WITH DIMMER

[75] Inventor: Greg A. Brownell, South Bend, Ind.

[73] Assignee: SEG Corporation, Mishawaka, Ind.

[21] Appl. No.: 79,083

[22] Filed: Jun. 16, 1993

[51] Int. Cl.[6] ..... H05B 41/392

[52] U.S. Cl. ..... 315/307; 315/DIG.4; 315/DIG. 7; 315/194

[58] Field of Search ..... 315/209 R, DIG. 4, DIG. 5, 315/194, 307, 291, 176, 360, DIG. 7; 323/237, 238, 239

[56] References Cited

U.S. PATENT DOCUMENTS

| | | | |
|---|---|---|---|
| 3,424,947 | 1/1969 | Warner et al. | 315/166 |
| 3,919,592 | 11/1975 | Gray | 315/199 |
| 3,935,505 | 1/1976 | Spiteri | 315/194 |
| 4,163,925 | 8/1979 | Gyursanszky | 315/276 |
| 4,350,935 | 9/1982 | Spira et al. | 315/291 |
| 4,567,425 | 1/1986 | Bloomer | 323/237 |
| 4,604,552 | 8/1986 | Alley et al. | 315/176 |
| 4,651,060 | 3/1987 | Clark | 315/199 |
| 4,663,569 | 5/1987 | Alley et al. | 315/175 |
| 4,950,963 | 8/1990 | Sievers | 315/360 |
| 5,001,386 | 3/1991 | Sullivan et al. | 315/219 |
| 5,004,953 | 4/1991 | McDonald | 315/86 |
| 5,038,081 | 8/1991 | Maiale, Jr. et al. | 315/291 |
| 5,144,205 | 9/1992 | Motto et al. | 315/244 |

*Primary Examiner*—Robert J. Pascal
*Assistant Examiner*—Arnold Kinkead
*Attorney, Agent, or Firm*—Barnes & Thornburg

[57] ABSTRACT

A fluorescent lamp control circuit includes a dimmer and a sensor. The dimmer is electrically connected in parallel with the fluorescent lamp. The sensor is electrically connected in parallel with the dimmer and lamp. The dimmer adjustably controls the brightness of the lamp when an operating voltage is applied to the lamp. The sensor electrically disables the dimmer when a starting voltage is applied to the lamp and electrically enables the dimmer when an operating voltage is applied to the lamp. The sensor includes a voltage controlled switch, a voltage regulator, a direct current power supply, and a voltage controlled trigger. An output of the voltage regulator is electrically connected to an input of the voltage controlled switch. The voltage controlled trigger is electrically connected between an output of the direct current voltage supply and an input of the voltage regulator. The dimmer includes a current controlled switch, a variable phase-shift (RC) network, and a voltage controlled switch. The voltage controlled switch is electrically connected between an output of the variable phase-shift (RC) network and an input of the current controlled switch.

9 Claims, 2 Drawing Sheets

FLUORESCENT LAMP CONTROL CIRCUIT WITH DIMMER

BACKGROUND AND SUMMARY OF THE INVENTION

The present invention relates to an electronic control circuit for a fluorescent lamp. More particularly, the present invention relates to a sensor and dimmer circuit for use with a fluorescent lamp ballast and fluorescent lamp.

Fluorescent lamps and housings therefor can be used as task lights for work station areas. See U.S. patent application Ser. No. 08/069,932 filed on May 28, 1993, entitled "Motion Sensor Assembly," by inventor Greg A. Brownell (attorney docket number 12636/80942), currently pending, the specification and drawings of which are incorporated herein by reference.

A fluorescent lamp is an electrical discharge device filled with a gas produced by vaporizing droplets of mercury within a closed tube. The inner surface of the lamp is coated with a fluorescent powder such as phosphor crystals. Electrodes (filaments) are located at each end of the tube for trigger start and rapid start lamps. When a proper voltage is applied to the filaments, they heat and ionize the gas within the tube. The ionized gas in turn causes the fluorescent powder to emit visible light. This condition within the tube is sometimes referred to as lamp arc. Lamp arc is the current flow through the ionized gas within the lamp which in turn causes the phosphor coating to fluoresce. The voltage required to produce lamp arc is often larger than the voltage supplied by conventional (e.g. 115 volts rms) electric outlets. Once lamp arc begins, the impedance of the lamp lowers. The lamp arc current is limited to a predetermined value by the impedance of a ballast winding, to provide the specified lamp wattage. The voltage across the lamp is accordingly reduced by the combination of the arc current and the ballast impedance. Current is limited in order to increase lamp life or, in some cases, prevent lamp destruction.

The ballast is used to supply a proper voltage to start the fluorescent lamp (starting voltage). The ballast supplies the starting voltage to both heat the filaments and begin lamp arc. Once lamp arc begins, the lamp voltage is reduced by the impedance characteristics of the lamp to an operating voltage. When the operating voltage is applied across the lamp, the lamp current is limited to a predetermined value by the output impedance of the ballast. The operating voltage remains across the lamp until the lamp is turned off.

In some applications, a user may desire to control (dim) the light output (i.e., brightness) of a fluorescent lamp once the lamp has started. Dimming can be accomplished in a variety of ways. One method in which fluorescent lamp dimming can be accomplished is through the use of dimming or electronic ballasts. These ballasts perform the functions of "conventional ballasts" described above in addition to allowing a user to control the brightness of the lamp. These ballasts, however, are more expensive than "conventional ballasts" and often require an external dimming control. Another method in which fluorescent lamp dimming can be accomplished is by controlling the input power to the ballast. One method which accomplishes this utilizes a phase control circuit to control the average voltage applied to the input of the ballast. Changing the phase angle of the input voltage produces harmonic currents which reduce the rated power factor of the ballast. Thus, less of the power drawn by the ballast is used to light the lamp. This results in a ballast that does not utilize power as efficiently. In addition, such phase control circuits can cause harmonic distortion of input current waveforms that add on the neutral wire of an alternating current power source such that the current carried by the neutral wire is in excess of a rated amount. A further method in which fluorescent lamp dimming can be accomplished is by electrically switching loads into a lamp circuit to divert power from the lamp. Use of such loads, however, tends to involve bulky and complicated wiring.

A fluorescent lamp dimmer that solves the problems associated with the above-described dimmer circuits would be a welcome improvement. Such a fluorescent lamp control circuit is provided by the present invention. The subject fluorescent lamp control circuit includes a dimmer and a sensor. The dimmer is electrically connected in parallel with the fluorescent lamp. The sensor is electrically connected in parallel with the dimmer and lamp. The dimmer adjustably controls the brightness of the lamp when an operating voltage is applied to the lamp. The sensor electrically disables the dimmer when a starting voltage is applied to the lamp and electrically enables the dimmer when the operating voltage is applied to the lamp.

The sensor includes a voltage controlled switch, a voltage regulator, a generally current voltage supply, and a voltage controlled trigger. An output of the voltage regulator is electrically connected to an input of the voltage controlled switch. The voltage regulator supplies a voltage to the voltage controlled switch to open and close the switch. The voltage controlled trigger is electrically connected between an output of the direct current voltage supply and an input of the voltage regulator. When triggered, the voltage controlled trigger supplies current to the voltage regulator.

In a preferred embodiment, the voltage controlled switch of the sensor includes inverse-series metal-oxide semiconductor field-effect transistors (MOSFETs). In this embodiment, the output of the voltage regulator is connected to the gates of the inverse-series metal-oxide semiconductor field-effect transistors. The voltage regulator may include a capacitor electrically connected in parallel with a zener diode and a resistor. The direct current voltage supply may include a half-wave rectifier that can be constructed from a diode which is electrically connected in series with a capacitor. The direct current voltage supply may further include a voltage divider electrically connected in parallel with the capacitor of the half-wave rectifier. This voltage divider provides at least two voltages, one of which appears at the output of the direct current voltage supply. A filter is electrically connected to the voltage appearing at the output of the direct current voltage supply. The filter enhances linearization of the voltage to which the filter is electrically connected. The filter may include a capacitor electrically connected in parallel with the output of the direct current voltage supply. The trigger may include a sidac.

The dimmer includes a current controlled switch, a variable phase-shift (RC) network, and a voltage controlled switch. The voltage controlled switch is electrically connected between an output of the variable phase-shift (RC) net and an input of the current controlled switch.

In a preferred embodiment, the current controlled switch includes a triac. A snubber circuit is electrically connected in parallel with the triac. The snubber circuit suppresses the sudden voltage rises appearing across the triac caused by the ballast when the triac opens. The snubber circuit may include a capacitor and a resistor. The variable phase-shift (RC) network may include a voltage divider network connected in series with a capacitor. The voltage divider network includes a device that allows the triggering of the voltage controlled switch to be adjusted at a particular phase angle of the operating voltage. The adjusting device may include a potentiometer. The variable phase-shift (RC) network may also include an anti-hysteresis network. The anti-hysteresis network may include a resistor and a capacitor. The voltage controlled switch includes a diac.

The dimmer may also include a radio frequency interference filter for suppressing radio frequency interference caused by the dimmer. The radio frequency interference filter may include an inductor that is electrically connected with a capacitor.

Other objects, advantages and novel features of the present invention will become apparent from the following detailed description of the invention when considered in conjunction with the accompanying drawings.

DETAILED DESCRIPTION OF THE DRAWINGS

Figure 1:
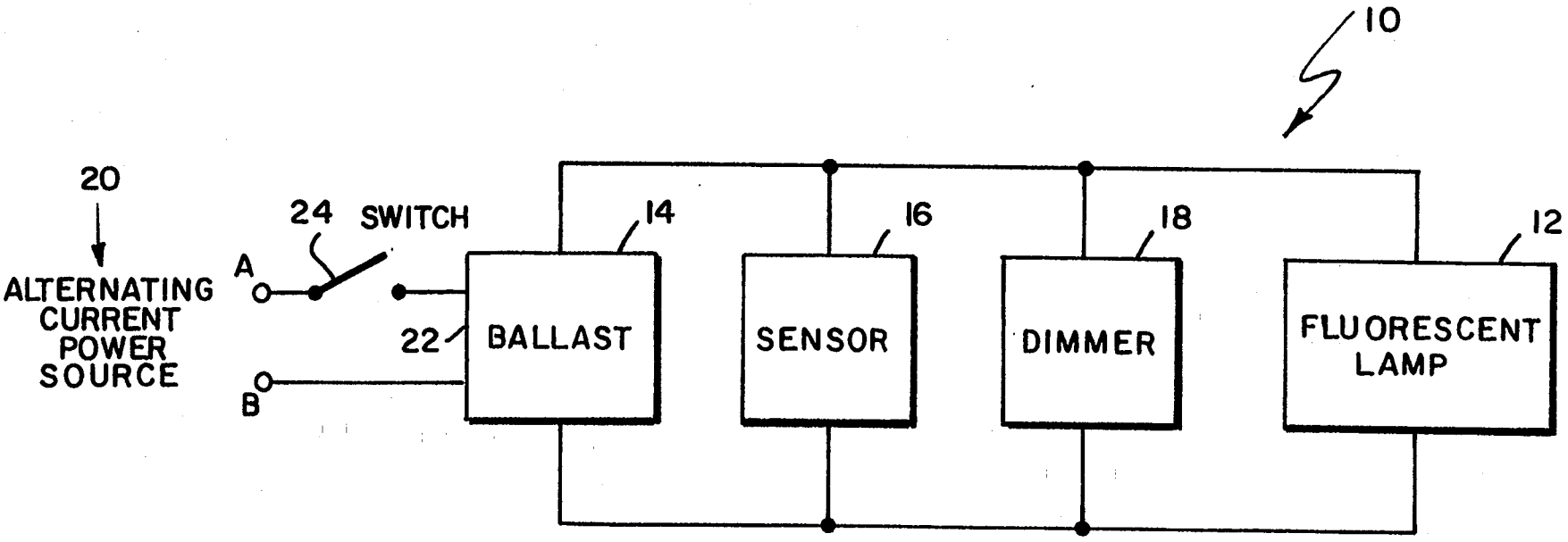
FIG. 1 shows a block connection diagram of a fluorescent lamp and fluorescent lamp ballast electrically connected in parallel with a sensor and dimmer of the present invention.

FIG. 1 shows a connection diagram 10 for a fluorescent lamp 12, fluorescent lamp ballast 14, sensor 16 and dimmer 18. As can be seen from FIG. 1, lamp 12, sensor 16 and dimmer 18 are electrically connected in parallel. An alternating current power source 20 is supplied between terminals A and B on the input side 22 of ballast 14. A switch 24 is used to electrically connect input side 22 of ballast 14 to alternating current power source 20.

Ballast 14 supplies a starting voltage across lamp 12 to turn lamp 12 on. After lamp 12 is lit, ballast 14 supplies an operating voltage, of lower potential than the starting voltage, across lamp 12 to keep lamp 12 lit. Once the operating voltage appears across lamp 12, dimmer 18 is enabled by sensor 16 and can be utilized to change the intensity 0f light emitted by lamp 12.

Figure 2:
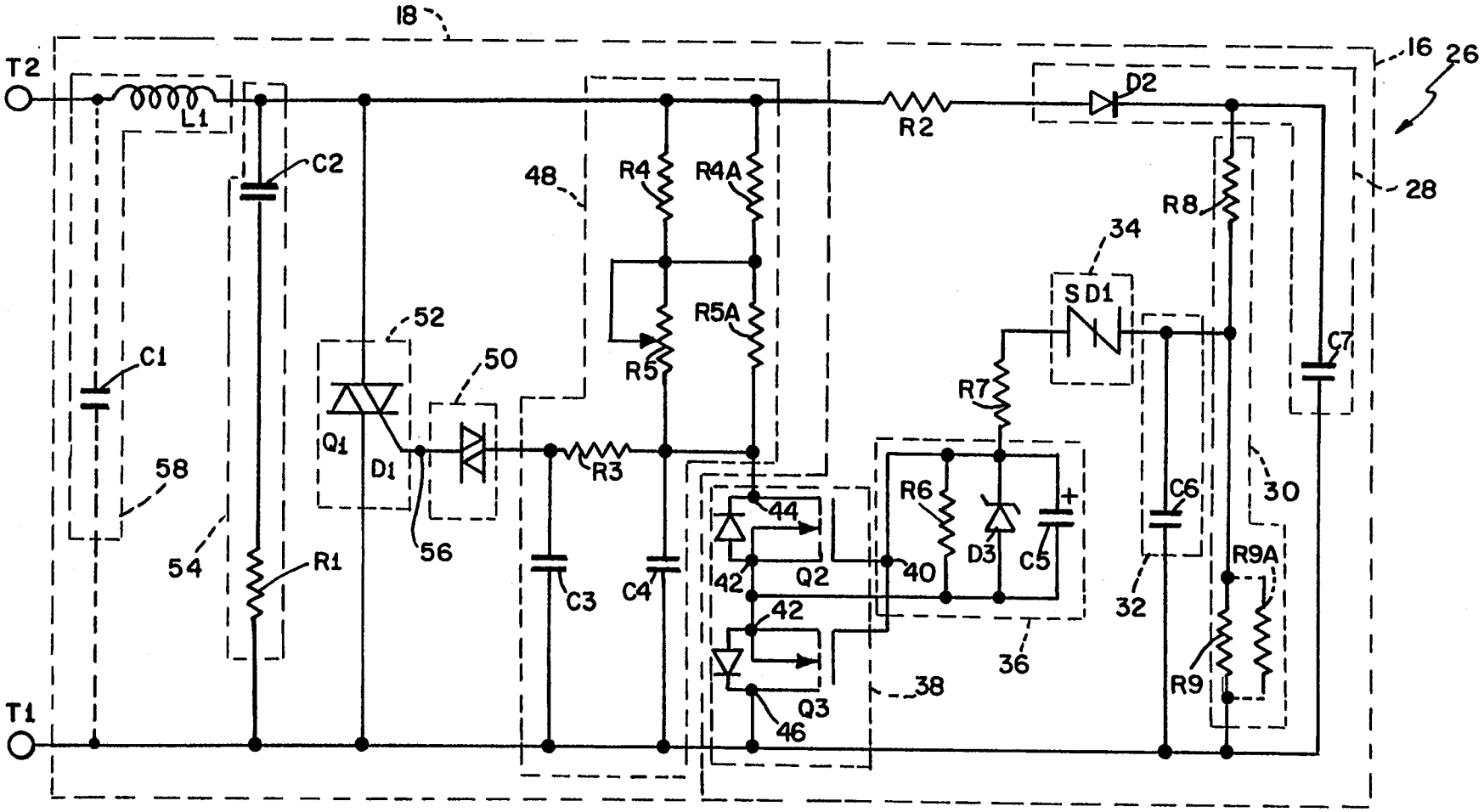
FIG. 2 shows a circuit diagram of an embodiment of the fluorescent lamp control circuit of the present invention.

FIG. 2 shows an embodiment of a fluorescent lamp control circuit 26 constructed in accordance with the present invention. Circuit 26 includes both sensor 16 and dimmer 18. Sensor 16 includes a direct current voltage supply 28, a voltage divider 30, a filter 32, a trigger 34, a voltage regulator 36 and a voltage controlled switch 38. Direct current voltage supply 28 is shown as including diode D2 and capacitor C7. Diode D2 and capacitor C7 form a half-wave rectifier that allows only the positive half cycle of either the operating voltage or starting voltage to pass therethrough. Voltage divider 30 is electrically connected in parallel with capacitor C7 of direct current voltage supply 28. Voltage divider 30 includes two resistors R8 and R9 that attenuate the direct current voltage appearing across capacitor C7 into two values. An optional resistor R9A is shown electrically connected in parallel with resistor R9. Resistor R9A allows the voltage appearing across resistor R9 to be lowered. Filter 32 is electrically connected in parallel with the resistor R9 of voltage divider 30. Filter 32 is shown in FIG. 2 as a capacitor C6. Filter 32 is designed to reduce ripple in the voltage appearing across resistor R9. This further smooths the voltage applied to trigger 34. Trigger 34 is shown as being electrically connected in series between filter 32 and voltage regulator 36. Trigger 34 is shown as a sidac SD1. Sidac SD1 blocks current flow until a sufficient breakover voltage is applied across it. Voltage regulator 36 includes a resistor R6 and capacitor C5 both of which are electrically connected in parallel with zener diode D3. The voltage appearing across the components of regulator 36 is thus clamped by the breakdown voltage of zener diode D3. Voltage controlled switch 38 is shown as inverse-series metal-oxide semiconductor field-effect transistors (MOSFETs) Q2 and Q3. As can be seen in FIG. 2, the gates 40 and sources 42 of transistors Q2 and Q3 are connected across voltage regulator 36. Drain 44 of transistor Q2 is connected to dimmer 18 and drain 46 of transistor Q3 is connected to common power supply rail T1.

When lamp 12 is being turned on, only sensor 16 of circuit 26 is enabled. Ballast 14 (see FIG. 1) supplies an starting voltage across T2 and T1. The positive half cycle of the starting voltage is rectified by direct current voltage supply 28. The direct current voltage of supply 28 is attenuated by voltage divider 30. The attenuated direct current voltage appearing across resistor R9 of voltage divider 30 is filtered by capacitor C6 of filter 32 to reduce ripple in the voltage appearing across resistor R9. A voltage, at least sufficient enough to trigger sidac SD1 so that it conducts current, is applied across sidac SD1. This current flows through resistor R7 and charges capacitor C5 to a level clamped by zener diode D3. When capacitor C5 is charged, a sufficient voltage appears at gates 40 of transistors Q2 and Q3 to cause them to turn on (conduct). The negative half cycle of the operating voltage is blocked by direct current voltage supply 28 because of diode D2. Thus, no current flows to voltage regulator 36 because sidac SD1 is not triggered. Therefore, sufficient charge must be developed across capacitor C5 to maintain adequate voltage at gates 40 so that transistors Q2 and Q3 conduct during the negative half cycle of the operating voltage. When transistors Q2 and Q3 conduct, dimmer 18 is disabled.

After lamp 12 has started, ballast 14 reduces the voltage supplied across lamp 12 to an operating voltage below that of the starting voltage. This operating voltage is of insufficient magnitude to cause sidac SD1 to be triggered. Current therefore does not flow to capacitor C5 to charge it. C5 is discharged by resistor R6. Because insufficient voltage appears at gates 40 of transistors Q2 and Q3, they turn off (do not conduct). When transistors Q2 and Q3 are not conducting, dimmer 18 is enabled.

Dimmer 18 adjustably controls the brightness of lamp 12 when the operating voltage appears across T2 and T1. Dimmer 18 includes an variable phase-shift (RC) network 48, a voltage controlled switch 50, a current controlled switch 52, and a snubber circuit 54. Variable phase-shift (RC) network 48 is shown as including resistors R3, R4, R4A, RSA, potentiometer R5 and capacitors C3 and C4. Voltage controlled switch 50 is shown as a diac D1 which conducts when a sufficient voltage is applied to it. Potentiometer R5 allows the brightness of lamp 12 to be adjusted by varying the time constant of the variable phase-shift (RC) network 48 such that diac D1 is triggered at a particular phase angle of the operating voltage. Resistors R4A and RSA can be substituted to provide multiple control ranges of the resistive component of variable phase-shift (RC) network 48. This allows dimmer 18, with minor modifications, to operate on a variety of different lamp 12 and ballast 14 combinations.

Resistor R3 and capacitors C3 and C4 form an anti-hysteresis network that reduces the tendency of dimmer 18 to "snap-on" or suddenly jump from a non-dimmed to a dimmed condition when diac D1 is triggered. Current controlled switch 52 is shown as a triac Q1. Gate 56 of triac Q1 is electrically connected in series with diac D1. Triac Q1 is enabled (conducts current) when trigger pulses from D1 appear at its gate 56. Because dimmer 18 and lamp 12 are electrically connected in parallel, when triac Q1 is conducting, current supplied by ballast 12 is diverted from lamp-14 to dimmer 18 such that lamp 12 is not lit. That is, lamp 12 is off when triac Q1 is enabled and on when triac Q1 is disabled.

Snubber circuit 54 is electrically connected in parallel with triac Q1. Snubber circuit 54 is shown as including a capacitor C2 and a resistor R1. Snubber circuit 54 suppresses fast voltage rises across triac Q1 when Q1 turns off, which may cause false (out of sync) triggering of Q1.

Dimmer 18 may include an optional radio frequency interference filter 58. Filter 58 is designed to slow high speed switch transients produced by dimmer 18. Filter 58 is shown as including an inductor L1 electrically connected in series between T2 and dimmer 18 and a capacitor C1 electrically connected in parallel with dimmer 18 across T1 and T2.

One advantage of circuit 26 is that during the time that Q1 is conducting, current which normally flows through lamp 12 to produce an arc and thus light lamp 12 is diverted through the filaments of lamp 12 and dimmer 18. This contributes additional heating power to the filaments that improves the reignition of the arc produced in lamp 12 when Q1 is not conducting. This allows a larger range of dimming control without degrading the operation or life of lamp 12. In addition, flicker in lamp 12 is reduced. Another advantage of circuit 26 is that hard starting of lamp 12, which reduces its life, is prevented by sensor 16 which only enables dimmer 18 after lamp 12 has started (i.e., once ballast 14 supplies the operating voltage). Another advantage of circuit 26 is that the rated power factor of ballast 14 is maintained because the ballast input current waveform is not distorted, creating harmonics, or shifted in phase. The input side 22 of ballast 14 is directly connected to alternating current power source 20. This direct connection of input side 22 of ballast 14 with power source 20 has the additional advantage that electrical switching noise generated by triac Q1 is not conducted back to alternating current power source 20, but rather "filtered" within ballast 14, so radio frequency interference is not allowed to escape from the system.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A control circuit for dimming a fluorescent lamp, comprising:

dimmer means electrically connected between an output load side of a fluorescent lamp ballast and a fluorescent lamp for adjustably controlling lamp brightness when an operating voltage is applied to the lamp by the output load side of the ballast after the lamp has started, the ballast receiving power at an input side from an alternating current power source; and sensor means electrically connected between the output load side of the lamp ballast and the lamp for electrically disabling the dimmer means when a starting voltage, greater in magnitude than the operating voltage, is applied to the lamp by the output load side of the ballast so that the lamp can be illuminated, and for electrically enabling the dimmer means when the operating voltage is applied to the lamp so that lamp brightness can be adjusted;

wherein the sensor means includes a voltage controlled switch, means for providing a regulated voltage to the voltage controlled switch to open and close the switch, means for providing a generally direct current voltage, and triggering means directly connected between an output of the direct current voltage providing means and an input of the regulated voltage providing means for supplying current to the input of the regulated voltage providing means;

wherein the direct current voltage providing means includes means for rectifying a positive portion of a cycle of the starting voltage; and wherein the direct current voltage providing means further includes means for attenuating an output of the rectifying means, the attenuating means providing at least two voltages, one of which appears at the output of the direct current voltage providing means.

2. The circuit of claim 1, wherein the attenuating means includes a resistive network.

3. The circuit of claim 1, further including means for filtering a voltage appearing at the output of the direct current voltage providing means to enhance linearization of the voltage.

4. The circuit of claim 3, wherein the filtering means includes a capacitor.

5. A control circuit for dimming a fluorescent lamp, comprising:

dimmer means electrically connected between an output load side of a fluorescent lamp ballast and a fluorescent lamp for adjustably controlling lamp brightness when an operating voltage is applied to the lamp by the output load side of the ballast after the lamp has started, the ballast receiving power at an input side from an alternating current power source; and sensor means electrically connected between the output load side of the lamp ballast and the lamp for electrically disabling the dimmer means when a starting voltage, greater in magnitude than the operating voltage, is applied to the lamp by the output load side of the ballast so that the lamp can be illuminated, and for electrically enabling the dimmer means when the operating voltage is applied to the lamp so that lamp brightness can be adjusted;

wherein the sensor means includes a voltage controlled switch, means for providing a regulated voltage to the voltage controlled switch to open and close the switch, means for providing a generally direct current voltage, and triggering means directly connected between an output of the direct current voltage providing means and an input of the regulated voltage providing means for supplying current to the input of the regulated voltage providing means; and wherein the triggering means includes a sidac.

6. A control circuit for dining a fluorescent lamp, comprising:

dimmer means electrically connected between an output load side of a fluorescent lamp ballast and a fluorescent lamp for adjustably controlling lamp brightness when an operating voltage is applied to the lamp by the output load side of the ballast after the lamp has started, the ballast receiving power at an input side from an alternating current power source; and sensor means electrically connected between the output load side of the lamp ballast and the lamp for electrically disabling the dimmer means when a starting voltage, greater in magnitude than the operating voltage, is applied to the lamp by the output load side of the ballast so that the lamp can be illuminated, and for electrically enabling the dimmer means when the operating voltage is applied to the lamp so that lamp brightness can be adjusted;

wherein the dimmer means includes a current controlled switch, variable phase-shift (RC) network means, and a voltage controlled switch electrically connected between an output of the variable phase-shift (RC) network means and an input of the current controlled switch for controlling opening and closing of the current controlled switch;

wherein the variable phase-shift (RC) network means includes means for providing an anti-hysteresis network;

wherein the anti-hysteresis network means includes a resistor and a capacitor; and wherein the sensor means a voltage controlled switch, means for providing a regulated voltage to the voltage controlled switch to open and close the switch, means for providing a generally direct current voltage, and triggering means directly connected between an output of the direct current voltage providing means and an input of the regulated voltage providing means for supplying current to the input of the regulated voltage providing means.

7. A fluorescent lighting circuit, comprising:

a fluorescent lamp;

a fluorescent lamp ballast having an input side and an output load side electrically connected in parallel with the lamp, the output load side of the ballast generating a starting voltage to begin illumination of the lamp and an operating voltage, of lesser magnitude than the starting voltage, to continue illumination of the lamp once the lamp is illuminated, the input side of the ballast receiving power from an alternating current power source;

a dimmer electrically connected between the output load side of the ballast and the fluorescent lamp, the dimmer adjustably controlling lamp brightness when the operating voltage is applied to the lamp;

a sensor electrically connected between the output load side of the ballast and the fluorescent lamp, the sensor including a voltage controlled switch, a voltage regulator, an output of which is electrically connected to an input of the voltage controlled switch, a direct current voltage supply, and a voltage controlled trigger directly connected between an output of the direct current voltage supply and an input of the voltage regulator;

wherein the sensor electrically disables the dimmer when the starting voltage is applied to the lamp and electrically enables the dimmer when the operating voltage is applied to the lamp;

wherein the direct current voltage supply includes a half-wave rectifier having a diode electrically connected in series with a capacitor; and a voltage divider electrically connected in parallel with the capacitor of the half-wave rectifier, the voltage divider providing at least two voltages, one of which appears at the output of the direct current voltage supply.

8. The circuit of claim 7, further including a filter electrically connected to a voltage appearing at the output of the direct current voltage supply, the filter enhancing the linearization of the voltage.

9. The circuit of claim 8, wherein the filter includes a capacitor electrically connected in parallel with the output of the direct current voltage supply.

* * * * *